US011497269B2

(12) United States Patent
Bakouros et al.

(10) Patent No.: US 11,497,269 B2
(45) Date of Patent: Nov. 15, 2022

(54) HAT WITH HIDDEN STORAGE COMPARTMENTS

(71) Applicants: Constandinos Bakouros, San Jose, CA (US); Maria Halatsis, San Jose, CA (US)

(72) Inventors: Constandinos Bakouros, San Jose, CA (US); Maria Halatsis, San Jose, CA (US)

( * ) Notice: Subject to any disclaimer, the term of this patent is extended or adjusted under 35 U.S.C. 154(b) by 115 days.

(21) Appl. No.: 16/902,418

(22) Filed: Jun. 16, 2020

(65) Prior Publication Data

US 2021/0386153 A1 Dec. 16, 2021

(51) Int. Cl.
*A42B 1/241* (2021.01)

(52) U.S. Cl.
CPC ..... *A42B 1/241* (2013.01)

(58) Field of Classification Search
CPC ..... A42B 1/241; A42B 1/0182; A42B 1/0189; A42C 5/02
See application file for complete search history.

(56) References Cited

U.S. PATENT DOCUMENTS 4,277,847 A * 7/1981 Florio ..... A42C 5/02 2/209.3
4,312,076 A * 1/1982 Gamm ..... A42B 1/241 2/209.13
5,704,070 A * 1/1998 Stogner ..... A42B 1/241 2/181.2
5,724,678 A * 3/1998 McCallum ..... A42B 1/241 2/209.13
5,887,287 A * 3/1999 Potochnik ..... A42B 1/241 2/172
5,907,871 A * 6/1999 Austin ..... A63B 71/143 2/209.12
6,023,788 A * 2/2000 McCallum ..... A42B 1/241 2/209.13
6,317,892 B1 * 11/2001 Galigani ..... A42B 1/201 2/209.12
6,357,051 B1 * 3/2002 Lee ..... A42B 1/201 2/195.6
6,920,644 B1 * 7/2005 Higgs ..... A42C 5/02 2/195.3

(Continued)

*Primary Examiner* — Heather Mangine
(74) *Attorney, Agent, or Firm* — Loza & Loza, LLP; Jessica W. Smith

(57) ABSTRACT

An interior surface storage structure for headgear is provided. The structure comprises a headgear, a plurality of contiguous panels disposed in a circular manner around an interior surface of the headgear, each panel separated from its immediately adjacent panel. The structure also comprises at least one pair of contiguous panels covered by fabric at panel edges to form a compartment, a panel edge along a circumference edge of the headgear open and providing access to the compartment. The structure also comprises a binding mechanism positioned at the panel edge along the circumference edge enabling compartment sealing, the binding mechanism concealed by a headband. The headgear alternatively does not have panels on the interior surface and the pocket enclosure is attached to the interior surface and to the circumference edge with binding mechanism concealed. Up to four pocket enclosures are installable on either side and in various configurations of the quadrants.

12 Claims, 6 Drawing Sheets

(56) References Cited

U.S. PATENT DOCUMENTS

| | | | | |
|---|---|---|---|---|
| 7,937,778 | B1 * | 5/2011 | Norton | A42B 1/08 2/175.4 |
| 8,458,820 | B2 * | 6/2013 | Cleva | A42B 3/12 2/171.8 |
| 2004/0139530 | A1 * | 7/2004 | Yan | A42B 1/241 2/209.13 |
| 2005/0210563 | A1 * | 9/2005 | Monshouwer | A42B 1/0189 2/195.1 |
| 2006/0185060 | A1 * | 8/2006 | Bang | A42B 1/0189 2/195.1 |
| 2007/0245458 | A1 * | 10/2007 | McGee | A42B 1/06 2/195.3 |
| 2011/0094014 | A1 * | 4/2011 | Chang | A42B 1/248 2/175.1 |
| 2012/0060259 | A1 * | 3/2012 | Fai | A42B 1/241 2/209.13 |
| 2014/0143939 | A1 * | 5/2014 | Olivares Velasco | A41D 31/125 2/414 |
| 2016/0007667 | A1 * | 1/2016 | Morrow | A42B 1/0182 2/195.1 |
| 2017/0035135 | A1 * | 2/2017 | Gimena | A42B 1/241 |
| 2018/0103708 | A1 * | 4/2018 | Ruffolo | A42B 1/241 |
| 2019/0021429 | A1 * | 1/2019 | Diez De Sollano Díaz | A42B 1/241 |
| 2019/0353463 | A1 * | 11/2019 | Saad | A42B 1/205 |
| 2020/0068975 | A1 * | 3/2020 | Brzoska | A42B 1/0183 |
| 2020/0229526 | A1 * | 7/2020 | Santos | A42B 1/241 |
| 2021/0386153 | A1 * | 12/2021 | Bakouros | A42B 1/241 |
| 2022/0047027 | A1 * | 2/2022 | Marquez Diaz | A42B 1/241 |

* cited by examiner

HAT WITH HIDDEN STORAGE COMPARTMENTS

FIELD OF THE DISCLOSURE

The present disclosure is in the field of headgear. More particularly, the present disclosure teaches systems and methods of placing a compartment on an inside surface of a hat with an opening below a headband, making detection of the compartment difficult.

BACKGROUND

Hats, caps, and other headgear are used for a variety of reasons, including protection against weather conditions, ceremonial reasons, such as university graduation, religious reasons, safety, or as a fashion accessory. A primary use of headgear is to shade the face and shoulders from the sun, protect against sun and rain and keep the head and ears warm. Some hats are worn for ornamental purposes and to communicate rank or position. Hats may also be used for storage of personal items with storage in a visor of a hat or attached to an exterior area of the hat.

DETAILED DESCRIPTION

Figure 1:
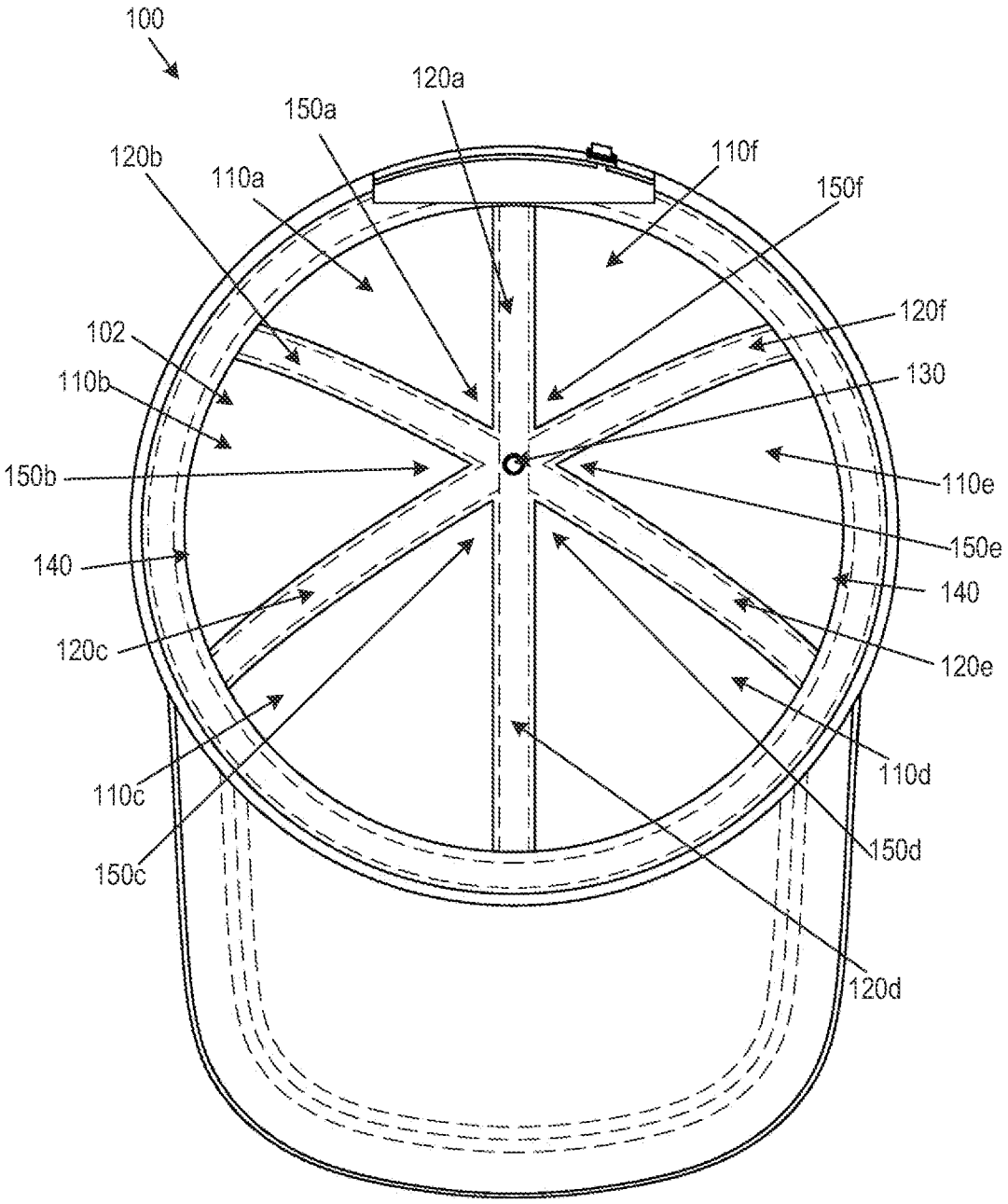
FIG. 1 is a diagram of a hat with hidden storage compartments in accordance with an embodiment of the present disclosure.

Systems and methods described herein provide for at least one compartment unobtrusively attached to an inside surface of a headgear comprising a hat or cap. An opening for the compartment with zipper or other closing device is concealed below a headband surrounding the circumference edge of the headgear. The presence of the compartment in the headgear may therefore be difficult to detect, providing security for the user's valuables or other belongings held in the compartment. [0010] In a typical cap, for example a baseball cap 100 shown in FIG. 1, the interior surface 102 is segmented into six triangular panels 110*a-f* of approximately equal size, with three on each side of the user's head. As seen in FIG. 1, each triangular panel 110*a-f* is attached to its immediately adjacent triangular panels by two of the plurality of seams 120*a-b*. For example, triangular panel 110*a* is attached to its immediately adjacent triangular panels 110*f* and 110*b* by first seam 120*a* and second seam 120*b* respectively. Triangular panel 110*b* is attached to its immediately adjacent triangular panels 110*a* and 110*c* by second seam 120*b* and third seam 120*c*. Triangular panel 110*c* is attached to its immediately adjacent triangular panels 110*b* and 110*d* by third seam 120*c* and fourth seam 120*d*. Triangular panel 110*d* is attached to its immediately adjacent triangular panels 110*c* and 110*e* by fourth seam 120*d* and fifth seam 120*e*. Triangular panel 110*e* is attached to its immediately adjacent triangular panels 110*d* and 110*f* by fifth seam 120*e* and sixth seam 120*f*. Triangular panel 110*f* is attached to its immediately adjacent triangular panels 110*a* and 110*e* by first seam 120*a* and sixth seam 120*f*. The vertices 150*a-e* of the triangular panels 110*a-e* meet at a center point 130 of the interior surface and wherein edges of each triangle panel 110 opposite corresponding vertex 150 are positioned along the circumference edge 140 of the headgear 100. The present disclosure provides for each compartment 300 to cover two contiguous panels 110 such that a credit card or driver license may be stored.

Compartments 300*a-b* as provided herein do not overlap each other and are situated on only one side or the other, i.e. they are not partially on one side and the other at the same time. Therefore, one compartment 300 per side of a baseball-type cap 100 is provided for with a total of two compartments 300 therefore provided for herein.

A user's valuables may be organized within one or two hidden compartments 300. There can be one pocket within the hat in any of the four located compartment areas or "zones" 200*a-d* shown in FIG. 2. The four zones in FIG. 2 comprise the front two pairs of triangular panels on either side of the hat 110*b-c*, 110*d-e*, each pair demarked by heavy dotted lines, and the rear two pairs of triangular panels on either side of the hat 110*a-b*, 110*e-f*, each pair demarked by solid lines. On each side of the hat the front zones 200*b*, 200*c* and rear zones 200*a*, 200*d* overlap at the center panel 110*b* or 110*e* such that a compartment 300*a-b* on each side can only be in the front zone 200*b*, 200*c* or rear zone 200*a*, 200*d* as each compartment 300*a-b* consumes a zone 200*a-d* or two of the panels 110*a-f*.

Figure 2:
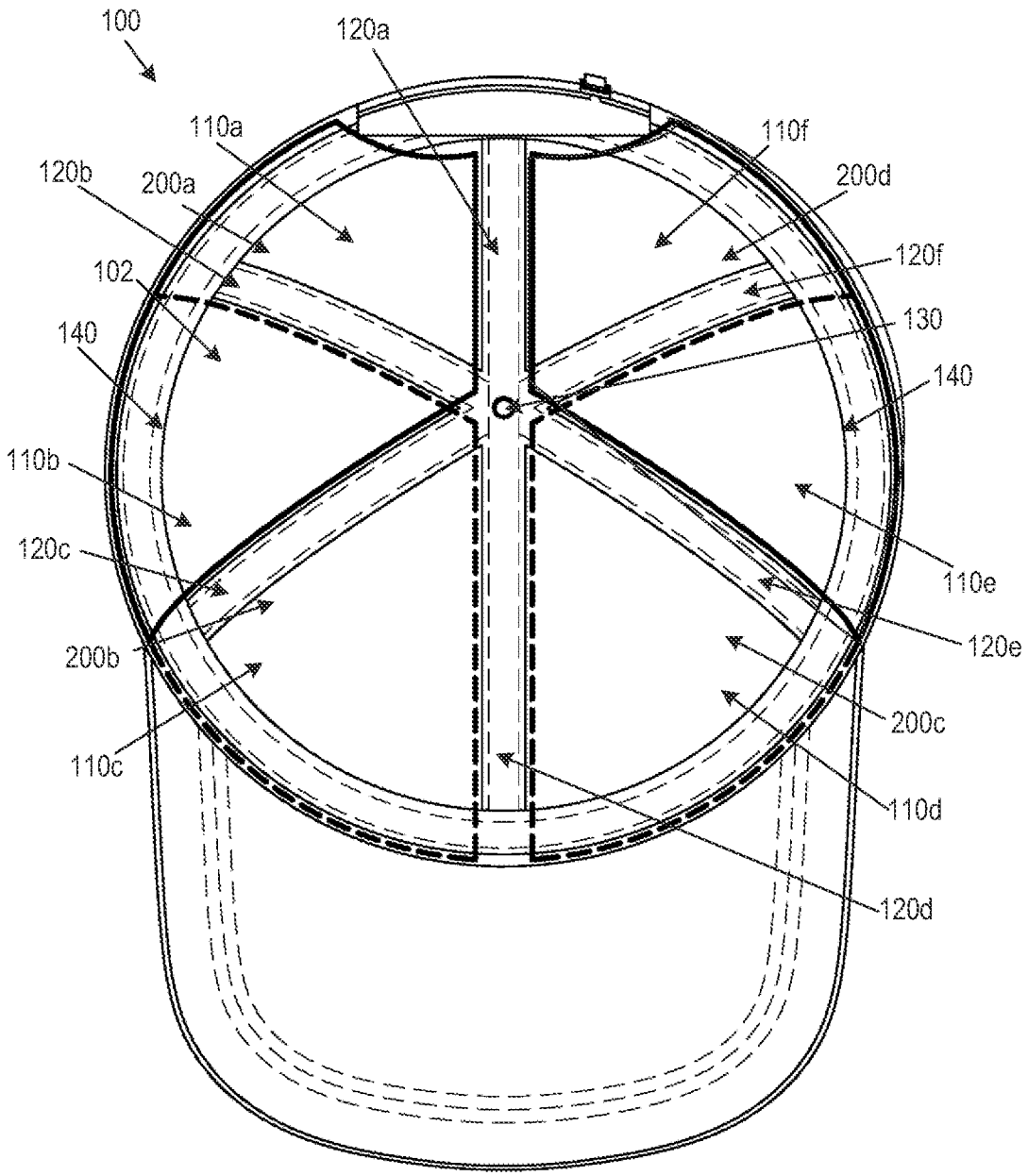
FIG. 2 is a diagram of a hat with hidden storage compartments in accordance with an embodiment of the present disclosure.

There can be one or two compartments 300 in any variation per hat as seen in FIG. 2 although compartments 300, as noted, do not overlap. The compartment material can be made of any fabric, whether it is completely opaque, mesh, or transparent.

The compartment 300 need not be of any a specific dimension or shape. When two compartments 300 are in effect, they need not be of equal size or equal in other respects. For instance, one compartment 300 may have a zipper enclosure and the other compartment may have a button enclosure. The compartments 300 need only occupy one of the four zones 200*a-d* in FIG. 2. The height and width of the hidden pocket 300 can be any dimension although in a preferred embodiment each compartment 300 would cover two of the contiguous panels 110*e-f* as shown in the zones 200*a-d* of FIG. 2. The width of the hidden pocket 300 can be altered, so long as it sits within one or two of the hidden compartment locations 200*a-d* listed in FIG. 2. Seams 120*a-f* between panels 110*e-f* may be visible or may be concealed.

The pockets 300 are hidden in plain sight, as there is the concealed opening 302 underneath the headband 500 (shown in FIG. 5) of the hat 100 for each pocket 300, whether it be one or two pockets 300 within the hat, right or left hand side in any variation of the pocket compartment areas 200*a-d* depicted in FIG. 2. The pocket of each compartment is limited to the seam of that compartment, regardless of pocket size, and does not flow into any other compartment's pocket (whether or not there is more than one pocket compartment per hat).

Figure 3:
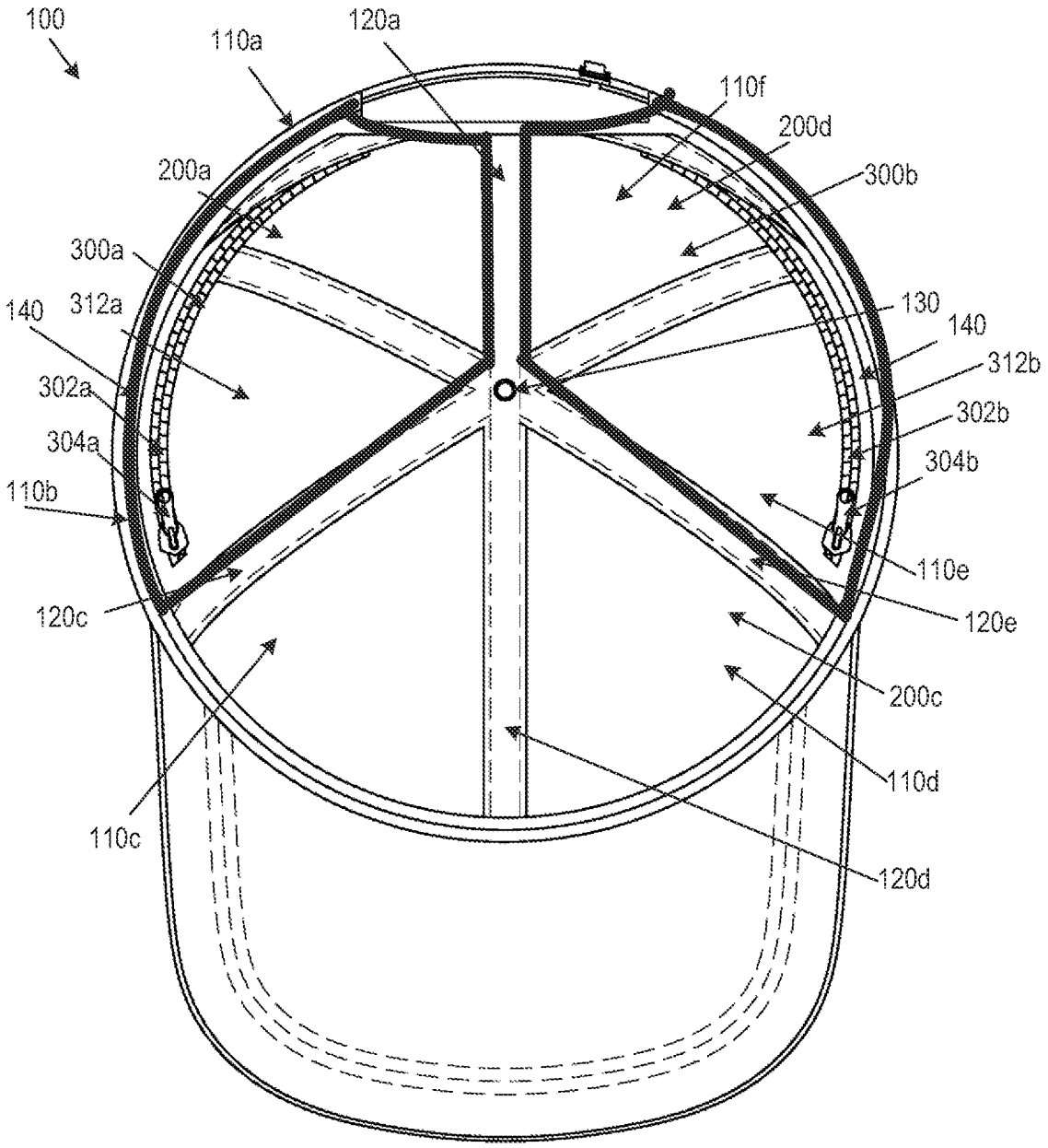
FIG. 3 is a diagram of a hat with hidden storage compartments in accordance with an embodiment of the present disclosure.

The hidden pocket opening 302 can be secured with a zipper 304*a-b* or any other type of closing mechanism, whether it be a hook and loop fastener including two strips, one covered with tiny loops and the other with tiny flexible hooks buttons, snaps, or clasps to ensure that valuables are safely held within the pocket 300. As seen in FIG. 3, the closing mechanism 304 is attached to the compartment fabric and positioned at the edges of the two contiguous panels 110*a-b* along the circumference edge 140 enabling sealing of the compartment 300. It may also not be secured with a closing mechanism and the opening 302 may just be a pocket with no securement closure. It may also be unsecured without a closing mechanism 304 and/or have a piece of securement netting or any extra fabric that overlaps the pocket to keep valuables in place. The enclosure mechanism 304 underneath the headband 500 can start any point of the pocket 300 vertically or horizontally, in any length or capacity, so long as the enclosure 304 is hidden behind the flipped-up headband 500. The headband 500 may also be referred to in embodiments as a sweatband and the two designations may be used interchangeably.

Figure 4:
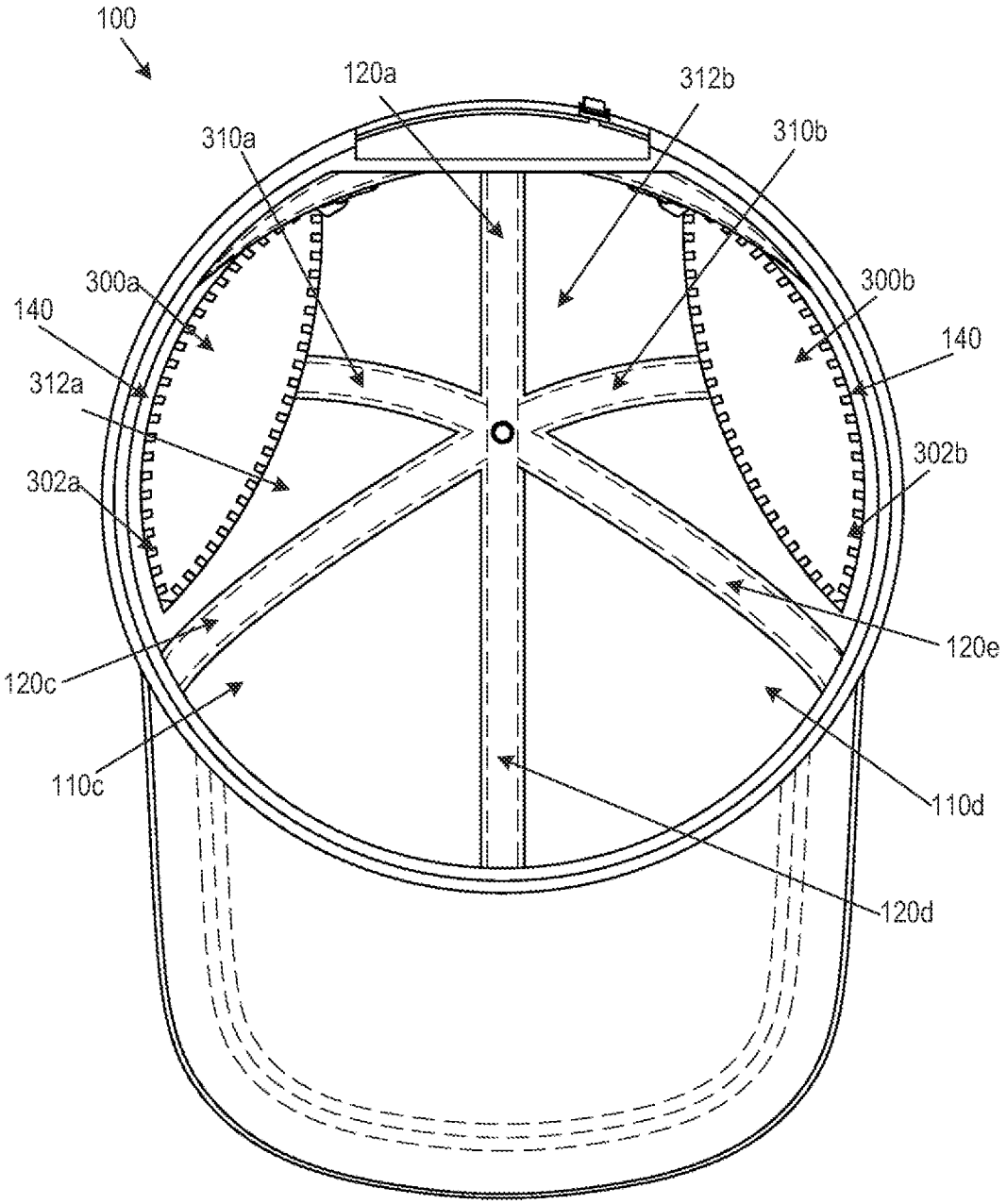
FIG. 4 is a diagram of a hat with hidden storage compartments in accordance with an embodiment of the present disclosure.
Figure 5:
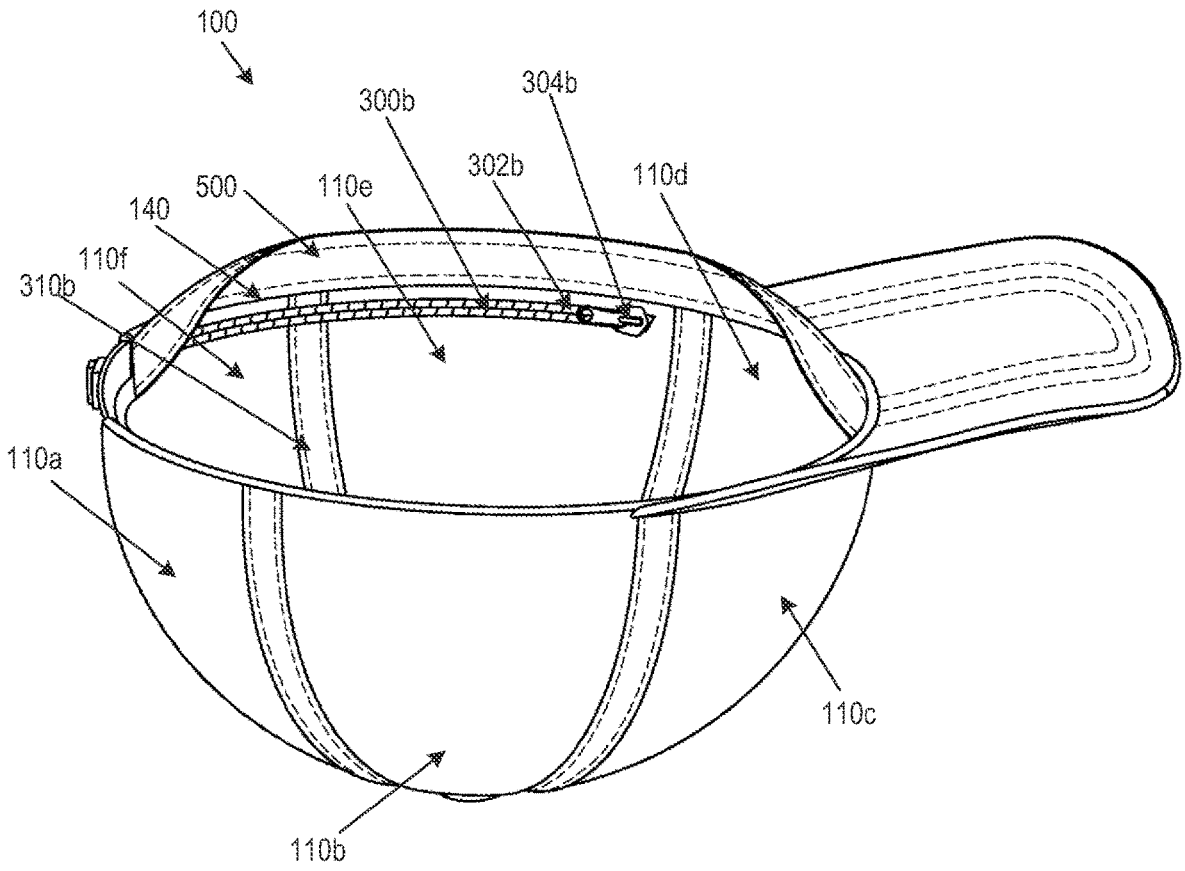
FIG. 5 is a diagram of a hat with hidden storage compartments in accordance with an embodiment of the present disclosure.

FIG. 3 illustrates zippers 304*a-b* around the headband 500 area of the hat 100 to seal and secure compartments 300*a-b* as described herein. Two contiguous panels with fabric coverings form the pocket enclosure, the pocket enclosure open and sealable at a lower edge along a circumference of the headgear. In FIG. 3, the separate zippers 304*a-b* seal separate compartments 300*a-b*, one compartment 300*a* situated at the rear left zone 200*a* and the other compartment 300*b* situated at the rear right zone 200*b* of the hat 100. The two zippers 304*a-b* would be concealed below the headband 500 of the hat 100 which folds in and over the zippers 304*a-b* after they have been closed. With thumb and index finger the user can pull the headband 500 down, open the zipper(s) 304*a-b* for one or both of the compartments 300*a-b*, insert items, close the zipper(s) 304*a-b*, and fold the headband 500 back into place. FIG. 4 depicts the two compartments 300*a-b* shown in FIG. 3 in open position, before their respective zippers 304*a-b* are pulled closed and the headband 500 folded into place. FIG. 5 depicts one of the zippers 304*b* from FIG. 4 and FIG. 5 partially obscured by the headband 500.

Figure 6:
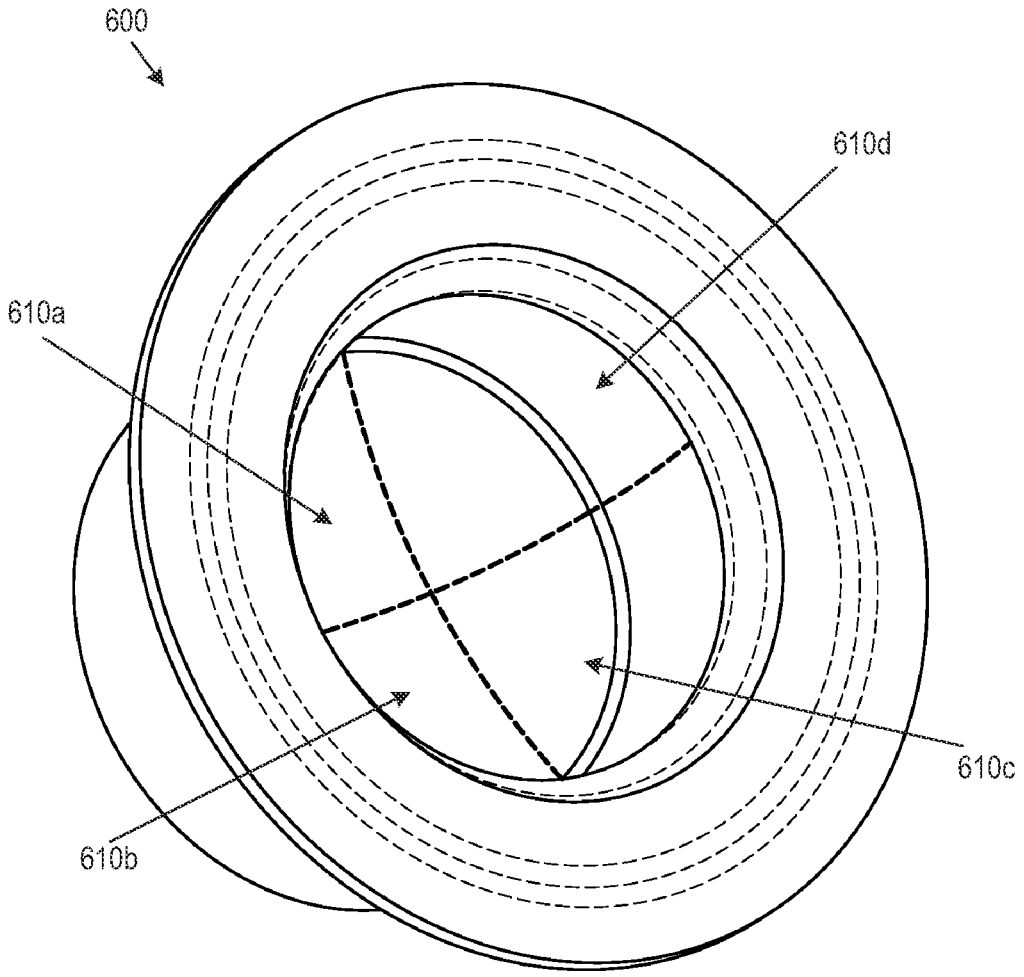
FIG. 6 is a diagram of a hat with hidden storage compartments in accordance with an embodiment of the present disclosure.

FIG. 6 is an illustration of a bucket hat 600. In embodiments, a baseball-type cap 100 need not be used. Any one of one, two, three, and four compartments on any side and any configuration of the four quadrants 610*a-d* may be possible in this embodiment.

There are still four quadrants 610*a-d* for the bucket hat 600 and other non-baseball caps. However, with the bucket hat 600 there are not limitations of having to utilize the full quadrant 610 for the compartment 300. There will still be up to four compartment quadrants 610*a-d* for the bucket hat and other non-baseball caps. The quadrant compartment size minimum would be a credit card width but can also be the full quadrant 610 (which would be larger than the credit card width). With the bucket hat and other non-baseball caps, there are not limitations as to the number of compartments 300 or their sizes.

The hat provided herein may be used for security and identification items; cash, cards, documents, licenses, keys, paper items, and other small objects that fit within the dimensions of each hidden pocket. A traveler may want to store valuables and personal items through any mode of transportation, such as airplanes, boats, cars, bicycles. A user may conduct a physical activity such as walking, running, working out, going to the gym. An everyday user may go to the store, school, work, medical visits, among other everyday activities.

A user may wish to attend a festival or concert. For leisure activities, the hat may be appropriate for activities such as going to the beach, the pool, fishing, staying at a hotel, hiking, horseback riding, dancing, cooking, birdwatching, gardening, and other leisurely activities. A user can apply various applications based on their lifestyle, physical activities, and can store whatever they may find valuable for that event.

What is claimed is:

1. A headgear, comprising:

a plurality of contiguous triangular fabric panels disposed in a circular manner to form an interior surface of the headgear, each triangular panel of the plurality of contiguous triangular fabric panels is attached to each immediately adjacent triangular panel of the plurality of contiguous triangular fabric panels by a seam;

a first compartment fabric that forms a first compartment between the interior surface of the headgear and the first compartment fabric, wherein the first compartment fabric covers a first triangular panel of the plurality of triangular panels and a second triangular panel of the plurality of triangular panels, wherein the first and second triangular panels are contiguous; and a second compartment fabric that forms a second compartment between the interior surface of the headgear and the second compartment fabric, wherein the second compartment fabric covers a third triangular panel of the plurality of triangular panels and a fourth triangular panel of the plurality of triangular panels, wherein the third and fourth triangular panels are contiguous, and wherein the first compartment fabric and the second compartment fabric are non-overlapping;

a bill extending from a front of the headwear;

wherein a right half a left half of the headwear are defined when bisecting the headgear from the front of the headgear to a rear of the headgear, and wherein the first compartment is entirely within the right half of the headwear and the second compartment is entirely within the left half of the headwear.

2. The headgear of claim 1, further comprising: a first closing mechanism attached to the first compartment fabric and positioned under a headband along a circumference edge of headgear wherein the closing mechanism is one of: a zipper, a hook and loop fastener device, at least one button, and at least one snap.

3. The headgear of claim 2, further comprising: a second closing mechanism attached to the second compartment fabric and positioned under the headband along a circumference edge of headgear.

4. The headgear of claim 3, wherein the second closing mechanism includes one of: a zipper, a hook and loop fastener device, at least one button, and at least one snap.

5. The headgear of claim 1, wherein the first compartment is positioned on a rear portion of the right half of the headgear and wherein the second compartment is positioned on a rear portion of the left half of the headgear.

6. The headgear of claim 1, wherein the first compartment is positioned on a front portion of the right half of the headgear and wherein second compartment is positioned on a front portion of the left half of the headgear.

7. A headgear including a bill extending from a front of the headgear, and a right side and a left side, wherein the right side and the left side of the headgear are defined when bisecting the headgear from the front of the headgear to a rear of the headgear, the headgear comprising:

a plurality of contiguous triangular panels disposed in a circular manner to form an interior surface of the headgear, each triangular panel of the plurality of contiguous triangular panels is attached to each immediately adjacent triangular panel of the plurality of contiguous triangular panels by a seam in the interior surface of the headgear;

a first compartment fabric positioned within the right side of the headgear that forms a first compartment entirely on the right side of the headgear between the interior surface of the headgear and the first compartment fabric, wherein the first compartment fabric covers a first triangular panel and a second triangular panel of the plurality of contiguous triangular panels on the right side of the headgear; and a second compartment fabric positioned within the left side of the headgear that forms a second compartment entirely on the left side of the headgear between the interior surface of the headgear and the second compartment fabric, wherein the first compartment fabric covers a first triangular panel and a second triangular panel of the plurality of contiguous triangular panels on the left side of the headgear.

8. The headgear of claim 7, further comprising:

a first closing mechanism positioned on the right side of the headgear along a lower circumference edge of the headgear, wherein the first closing mechanism enables sealing of the first compartment; and a second closing mechanism positioned on the left side of the headgear along the lower circumference edge of the headgear, wherein the second closing mechanism enables sealing of the second compartment.

9. The headgear of claim 8, wherein vertices of the plurality of contiguous triangular panels meet at a center point of the headgear and wherein edges opposite the vertices of each of the plurality of triangular panels are positioned along the lower circumference edge of the headgear.

10. The system of claim 9, wherein the first closing mechanism includes one of: a zipper, a hook and loop fastener device, at least one button, and at least one snap; and wherein the second closing mechanism includes one of: a zipper, a hook and loop fastener device, at least one button, and at least one snap.

11. The headgear of claim 7, wherein the first compartment fabric is positioned on one of: a rear portion of the right side of the headgear or a front portion of the right side of the headgear.

12. The headgear of claim 7, wherein the second compartment is positioned on one of: a rear portion of the left side of the headgear or a front portion of the left side of the headgear.

* * * * *